United States Patent [19]

Childers et al.

[11] Patent Number: 4,546,837

[45] **Date of Patent: * Oct. 15, 1985**

[54] DRILL BIT HAVING ANGLED NOZZLES FOR IMPROVED BIT AND WELL BORE CLEANING

[75] Inventors: John S. Childers, Greenville; Paul E. Pastusek, Houston, both of Tex.

[73] Assignee: Reed Tool Company, Houston, Tex.

[ * ] Notice: The portion of the term of this patent subsequent to May 14, 2002 has been disclaimed.

[21] Appl. No.: 625,495

[22] Filed: Jun. 28, 1984

Related U.S. Application Data

[63] Continuation-in-part of Ser. No. 437,927, Nov. 1, 1982, Pat. No. 4,516,642, which is a continuation-in-part of Ser. No. 132,950, Mar. 24, 1980, abandoned.

[51] Int. Cl.[4] ..... E21B 10/18

[52] U.S. Cl. ..... 175/340

[58] Field of Search ..... 175/340, 339, 67

[56] References Cited

U.S. PATENT DOCUMENTS

| | | | |
|---|---|---|---|
| 1,922,436 | 8/1933 | Herrington | 175/340 |
| 2,098,758 | 11/1937 | Reed | 175/340 |
| 2,244,617 | 6/1941 | Hannum | 175/340 |
| 2,815,936 | 12/1957 | Peter et al. | 175/340 |
| 3,014,544 | 12/1961 | Steen | 175/340 |
| 3,984,158 | 10/1976 | Sorensen et al. | 308/8.2 |
| 4,106,577 | 8/1978 | Summers | 175/340 |
| 4,187,920 | 2/1980 | Johnson | 175/340 |
| 4,222,447 | 9/1980 | Cholet | 175/340 |
| 4,239,087 | 12/1980 | Castel et al. | 175/340 |

FOREIGN PATENT DOCUMENTS

| | | | |
|---|---|---|---|
| 1104310 | 2/1968 | United Kingdom | 175/340 |

*Primary Examiner*—James A. Leppink
*Assistant Examiner*—Hoang C. Dang
*Attorney, Agent, or Firm*—Carl A. Rowold

[57] ABSTRACT

A rotary drill bit for drilling a well bore comprising a bit body adapted to be detachably secured to a drill string and receive drilling fluid under pressure therefrom and having a plurality of depending legs and a nozzle system for exit of drilling fluid from the bit body. The drill bit further comprises a plurality of roller cutters, each cutter having a generally conical roller cutter body rotatably mounted on one of the legs and a plurality of cutting elements on the cutter body. The nozzle system directs a plurality of streams of drilling fluid from the bit body, each stream being so directed as to flow generally toward the cutter body of a roller cutter, with the stream impinging at least one cutting element on the roller cutter body, and thereafter impinging the well bore bottom at least in part at a generally pie shaped portion of the bottom which is within the vertical projection of the roller cutter on the well bore bottom and forward, with respect to the direction of rotation of the drill bit, of the points of engagement of the cutting elements of this latter roller cutter with the well bore bottom for improved cleaning action.

12 Claims, 9 Drawing Figures

DRILL BIT HAVING ANGLED NOZZLES FOR IMPROVED BIT AND WELL BORE CLEANING

CROSS-REFERENCE TO OTHER APPLICATIONS

This is a continuation-in-part of U.S. patent application Ser. No. 437,927, filed Nov. 1, 1982, now U.S. Pat. No. 4,516,642 which is a continuation-in-part of U.S. patent application Ser. No. 132,950, filed Mar. 24, 1980, now abandoned.

BACKGROUND OF THE INVENTION

This invention relates to rotary drill bits for drilling oil wells and the like, and more particularly to rotary drill bits used in conjunction with the drilling fluid circulation system of a rotary drill rig.

This invention involves an improvement over rotary drill bits of the type, such as that shown, for example, in U.S. Pat. Nos. 3,984,158, 4,106,577 and 4,222,447 British Pat. No. 1,104,310 and FIG. 5 of this application, comprising a bit body having an upper portion adapted to be detachably secured to a drill string for rotating the bit, a chamber therein receiving drilling fluid under pressure from the drill string, and three depending legs each having an inwardly extending bearing journal. The bit further includes a roller cutter rotatably mounted on each bearing journal and three nozzles extending down between sets of adjacent roller cutters. The drill bit is used in conjunction with the drilling fluid circulation system of a drill rig, with the drilling fluid being pumped down through the passage in the drill pipe to the chamber in the drill bit, exiting the drill bit via the nozzles, and flowing back up to the surface in the annulus around the drill pipe. The nozzles direct the drilling fluid as high velocity streams against the bottom of the well bore to clean it, with the splash back of the drilling fluid from the bottom of the well bore impinging the roller cutters to provide limited cleaning action of the cutters. Drilling debris and cuttings from the bottom of the well bore are entrained in and are carried away from the bottom by the drilling fluid as it flows up the annulus.

While the above-described conventional drill bit may have been satisfactory for drilling relatively brittle formations, it does not provide satisfactory rates of penetration when drilling relatively plastically deformable formations. Many commonly encountered formations such as slates, shales, limestones, sandstones and chalks, become plastically deformable under so-called differential pressure conditions, which occur when the hydrostatic pressure of the column of drill fluid bearing on the bottom of the well bore exceeds the pressure of the formation surrounding the bore, as may happen in deep hole drilling. Whereas, brittle formations crack or fracture under the compressive loads applied by the cutting elements of a drill bit, plastic formations tend to deform and thus remain intact under such loads. In addition, certain of these plastic formations tend to form a relatively thick coating of drilling debris on the roller cutter which can result in so-called "bit-balling" and limited penetration of the formation by the cutting elements. Drill bits having a relatively large degree of offset between the axes of rotation of its roller cutters and the vertical centerline of its bit body are particularly susceptible to "bit balling."

As shown in U.S. Pat. Nos. 4,106,577, 4,222,447 and British Pat. No. 1,104,310, attempts have been made to increase the rate of penetration in plastic foundations by using extended nozzles for improving the cleaning action of the fluid circulation system. While this nozzle arrangement may offer some measure of improved cleaning action, it is still not satisfactory for many types of plastic formations. Moreover, in this arrangement, the nozzles extend down to points closely adjacent to the bottom of the well bore, and thus are subject to damage by irregularities, such as projections or ridges, on the bottom of the well bore, which may form from time to time during drilling operations.

SUMMARY OF THE INVENTION

Among the several objectives of this invention may be noted the provision of a rotary drill bit having improved hydraulic cleaning action and increased rates of drilling penetration in relatively plastically deformable formations; the provisions of such a drill bit which so directs streams of high velocity drilling fluid toward the roller cutters that the streams sequentially impinge and clean first cutting elements on the roller cutters and then the well bore bottom; the provision of such a drill bit which cleans the cutting elements on the roller cutters while they are out of engagement with the bottom of the well bore; the provision of such a drill bit which cleans portions of the bottom of the well bore when uncovered by the roller cutters for effective cleaning of the well bore bottom by the drilling fluid so as to present clean formation to the cutting elements; and the provision of such a drill bit having nozzles spaced well above the bottom of the well bore so as to prevent breakage of the nozzles.

In general, the drill bit of this invention comprises a bit body having a threaded pin at its upper end adapted to be detachably secured to a drill string for rotating the bit and delivering drilling fluid under pressure to the bit, a plurality of depending legs at its lower end, and nozzle means for exit of drilling fluid from the bit body. The drill bit further comprises a plurality of roller cutters, one for each leg, each roller cutter comprising a generally conical cutter body rotatably mounted on the respective leg and a plurality of cutting elements on the cutter body, each cutting element at least at a portion of its surface being formed of a material resistant to erosion by high velocity drilling fluid which may impinge it. The nozzle means directs a plurality of streams of drilling fluid from the bit body, each stream being so directed as to flow generally toward the cutter body of a roller cutter, with the stream impinging at least one cutting element on the roller cutter, and thereafter impinging the well bore bottom at least in part at a generally pie shaped portion of the bottom which is within the vertical projection of the roller cutter on the well bore bottom and forward, with respect to the direction of rotation of the drill bit, of the points of engagement of the cutting elements of this latter roller cutter with the well bore bottom, whereby cutting elements on each roller cutter and a portion of the well bore bottom beneath each roller cutter are subject to separate cleaning actions for enhanced drill bit cutting action.

Further, each stream of drilling fluid is so angled and positioned relative to the roller cutters that as a roller cutter rotates cutting elements thereon enter a stream for being cleaned thereby with each of the cutting elements exiting the stream prior to engaging the formation at the well bore bottom, and with the stream after flowing past the cutting elements impinging the well bore bottom.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
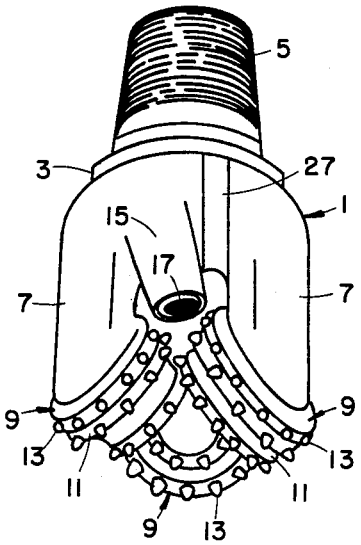
FIG. 1 is a side elevation of a first embodiment of a drill bit of this invention.

Referring to FIG. 1, there is generally indicated at 1, a first embodiment of a drill bit of this invention used in conjunction with the drilling fluid circulation system of a rotary drill rig (not shown) for drilling well bores in the earth. The bit comprises a bit body 3 having, a threaded pin 5 at its upper end, adapted to be threaded in a drill string (not shown), which serves to rotate the bit, and a chamber therein (not shown) for receiving drilling fluid under pressure from the passage of the drill string. At its lower end, the bit body has a plurality of depending legs 7, (e.g., three legs) each leg being spaced from the other legs and having an inwardly and downwardly extending, generally cylindrical bearing journal at its lower end. Roller cutters 9 are rotatably mounted on the bearing journals, each roller cutter 9 comprising a generally conical cutter body 11 having a recess in the base thereof receiving the respective bearing journal and a plurality of cutting elements 13 on the conical surface of the body. The cutting elements are arranged in annular rows around the cutter body, as shown in FIG. 1, and preferably comprise so-called "inserts" of a hard metallic material, such as a metal carbide (e.g., tunsten carbide). The inserts are relatively elongate members and are mounted on the cutter body by pressing base portions of the inserts in holes in the cutter body in an interference fit, with a portion thereof projecting outwardly from the cutter body. The projecting portions of the inserts are adapted to bear on the bottom 14 of the well bore for drilling the formation.

Figure 2:
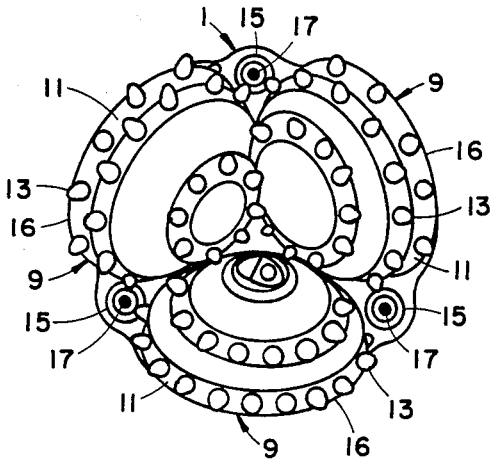
FIG. 2 is a bottom plan of FIG. 1 showing nozzles between adjacent roller cutters of the drill bit.
Figure 3:
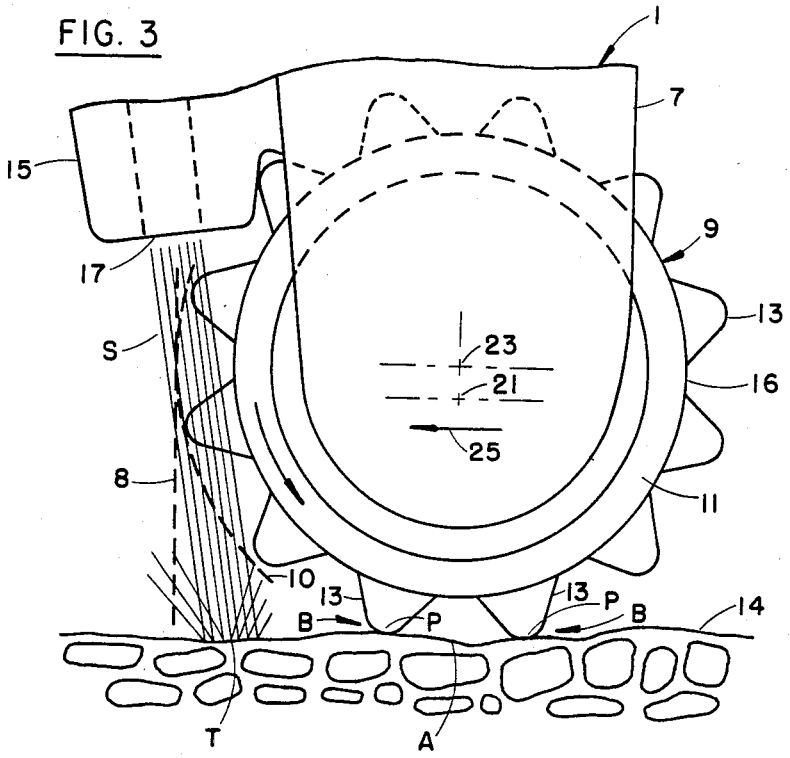
FIG. 3 is an enlarged partial side elevation of the drill bit on the bottom of a well bore showing a nozzle directing drilling fluid past an adjacent roller cutter and against the well bore bottom.

As shown in FIGS. 1–3, the drill bit further includes nozzle means comprising a plurality of elongate nozzles 15, (e.g., three nozzles) in the bit body having passaging in flow communication with the chamber in the bit body and opening to orifices 17 toward the bottom of the bit body 3. The nozzles extend down from the bit body generally between sets of adjacent pairs of roller cutters 9, and enable exit of the drilling fluid under pressure from the chamber. In accordance with this invention, these nozzle orifices 17 are positioned above the inclined central axis of the adjacent bearing journal at both ends thereof (i.e., above the centerline of the journal at the inner end thereof designated at 21 in FIG. 3 and at the outer end thereof designated at 23). Being so positioned, the elongate nozzles 15 are spaced well above the well bore bottom 14 and thus are protected against being engaged and damaged by irregularities, such as ridges or projections, on the bottom 14 as the bit rotates.

In addition, the nozzles 15 are so angled relative to the bit body 3 and roller cutters 9 that the nozzle passaging directs the drilling fluid under pressure to exit downwardly and in the direction opposite to the direction of rotation of the bit, indicated by arrow 25 in FIG. 3. As best illustrated in FIG. 3, the fluid flows in a high velocity stream, designated S, generally toward the underside of the adjacent roller cutter (i.e., the portion of the roller cutters below its longitudinal axis) along a line generally tangent to the cutter body 11 of the adjacent roller cutter. As the fluid flows past the cutters 9, it impinges inserts 13 of the gage row of inserts and the row adjacent thereto. As indicated, the cutting elements 13 are preferably formed at least at their outer projecting surfaces of a material, such as tungsten carbide, resistant to erosion by the streams S of high velocity drilling fluid. While each stream is shown in FIG. 3 as being tangent to the cutter body, it is contemplated that the stream may be spaced a short distance (e.g., one-quarter inch) from the body and extend along a line generally parallel to a tangent thereto. In addition, it is contemplated that the stream of drilling fluids may be so directed as to slightly impinge the roller cutter body. Such impingement likely offers improved cleaning action of the roller cutter body, but reduced cleaning action of the cutting elements, as compared to directing the stream solely against the cutting elements.

The roller cutter body is thus subject to being impinged by the high-velocity drilling fluid both directly, as described above, and indirectly. Indirect impingement results from splashing of the stream of high-velocity drilling fluid when it impinges the cutting elements. To withstand the erosion effects of being impinged by the high-velocity drilling fluid, the roller cutter body may be formed at least over a portion of its conical outer surface 16 of a suitable erosion resistant material, such as a tungsten carbide material. This material may be applied as a coating to the conical surface of a steel roller cutter body by conventional coating application processes, such as flame powder, flame wire, plasma or detonation thermal spraying processes. In addition, a composite material of tungsten carbide pellets and steel powder may be applied to the roller body by using a torch to melt the steel, the molten steel bonding the tungsten carbide to the roller cutter body when the steel cools to form an erosion resistant coating on the cutter body. Alternatively, the roller cutter may be formed of tungsten carbide at its outer surface such as shown in U.S. Pat. Nos. 4,276,788 and 4,368,788. It is also contemplated that the erosion resistant material may be other than a hard metal. For example, it may be a suitable elastomeric material; e.g., a nitrile rubber, applied as a coating to the roller cutter body.

After flowing past the roller cutter 9, the stream S of drilling fluid impinges portions of the bottom 14 of the well bore closely adjacent to, but spaced apart (i.e., ahead or forward with respect to the direction of rotation 25 of the drill bit) from all of the points, designated P in FIG. 3, of engagement of the inserts of the adjacent roller cutter with the bottom of the bore. At any given time, cutting elements 13 of each roller cutter 9 engage the well bore bottom at a generally pie shaped area (more particularly, a portion shaped as a piece or slice of pie) of the well bore bottom, designated A in FIGS. 3 and 6. At the same point in time, these cutting elements in turn constitute the engaging portion or bottom of the roller cutter, designated B in FIG. 3. At least a part or portion of the stream S of drilling fluid thus impinges a so-called "target" portion of the well bore bottom, designated T in FIGS. 3 and 6, within the vertical projection of the respective roller cutter 9 on the well bore bottom and forward, with respect to the direction of rotation of the drill bit, of the bottom B of the roller cutter and thus the area of engagement A of the roller cutter on the well bore bottom.

Figure 6:
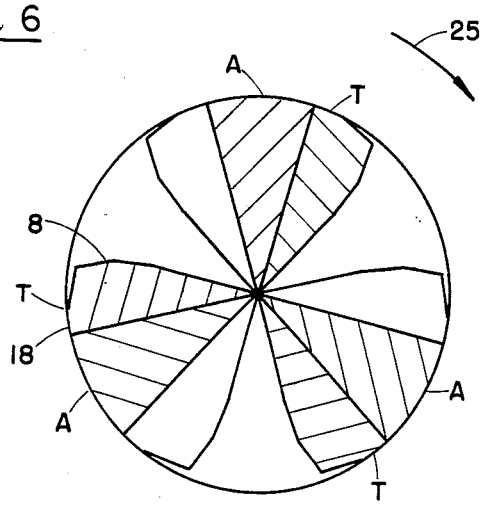
FIG. 6 is a top plan of the well bore bottom at a predetermined point in time showing areas of engagement of the roller cutters with the well bore bottom and target portions of the well bore bottom vertically below the roller cutters but not engaged by the roller cutters which are to be impinged by streams of drilling fluid.

As shown in FIGS. 3 and 6, this target portion T is defined at its leading edge by a vertically extending surface 8 which is tangent to the forward edge of the surface of revolution 10 of the roller cutter 9, at its trailing edge by the engagement area A of the well bore bottom, and at its radially outer edge by the side 18 of the well bore. Being so defined, the target area is generally pie shaped in top plan view as shown in FIG. 6. This definition of the target portion T of the well bore presupposes that the drill bit is in vertical position on a generally horizontal well bore bottom, as shown in the FIGS. However, it is to be understood, that if the bit were in inclined position as occurs in directional drilling, the target portion T would be the generally pie shaped portion of the well bore bottom within the projection of the roller cutter on the well bore bottom in the direction of the inclined longitudinal axis of the bit.

The target portion T of the well bore bottom 14 is cleaned by the respective high velocity stream of drilling fluid, thereby exposing a clean or virgin surface at the bottom 14 prior to its engagement by an insert 13. While the target portion of the well bore bottom impinged by the stream S is closely adjacent to the bottom B of the roller cutter, it is important to note that it is not covered by the roller cutter body (i.e., spaced from the underside of the roller cutter). By being uncovered or out of engagement by the roller cutter, the target portion may be freely impinged by the stream, and any cuttings on this portion may be washed away free of any flow restriction by the roller cutter. Moreover, by being closely adjacent the bottom of the roller cutter, the cleaned target portions of the well bore bottom remain substantially free of cuttings, which tend to relatively rapidly redeposit on the well bore bottom. Thus, the target portions of the well bore bottom are subject to the most effective cleaning action, and remain clean until engaged by the cutting elements.

It will be observed from the foregoing, that by so directing the stream S of drilling fluid both outer rows of inserts 13, as well as, the target portions T of the well bore bottom 14 are cleaned by the drilling fluid prior to the engagement of these portions of the well bore bottom by the inserts. Moreover as observed from FIG. 3, the passaging in each nozzle 15 directs the drilling fluid under pressure to flow in a stream S so angled and positioned relative to one of the roller cutters that as this roller cutter rotates cutting elements 13 thereon enter the stream for being cleaned thereby and then exit the stream prior to engaging the formation, with the stream after flowing past the cutting elements impinging the respective target portion T of the formation at the bottom of the well bore, whereby the formation and all of the cutting elements impinged by the stream are subjected to separate, sequential cleaning actions for presenting clean engagement surfaces. These separate, sequential cutting actions have been found to result in enhanced drill bit cutting action and increased rates of penetration, particularly in drilling relatively plastically deformable formations.

Figure 5:
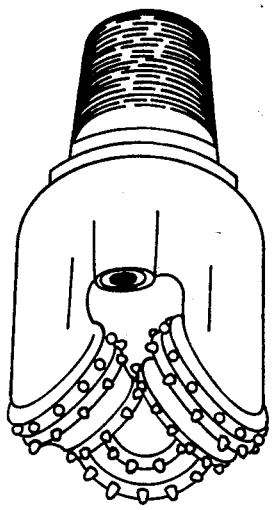
FIG. 5 PRIOR ART
FIG. 5 is a side elevation of a prior art drill bit.

Thus, the drill bit 1 of this invention represents an improvement over conventional drill bits of the type, such as shown in FIG. 5, in which the nozzles extend generally vertically and centrally down between adjacent roller cutters. Being so angled, these nozzles direct the drilling fluid so as not to impinge the roller cutter, but rather, only to impinge the formation at areas substantially forward of the roller cutter. As indicated previously, cuttings flushed from the well bore bottom tend to redeposit on the bottom. Because of the relatively long distance between the portion of the well bore bottom cleaned by the stream of the drilling fluid at any point in time and the bottom of the roller cutter, a layer of cuttings may be redeposited on the cleaned portion of the well bore bottom before being engaged by the roller cutter. Such a layer of cuttings would reduce the rate of penetration of the drill bit. The drill bit 1 also represents an improvement over drill bits of the type, such as shown in U.S. Pat. No. 4,106,577, 4,222,447 and British Pat. No. 1,104,310, in which the nozzles direct the drilling fluid so as to simultaneously engage the cutting elements of the roller cutter and the bottom of the well bore (i.e., engage the cutting elements only at their points of engagement with the formation). With the cutting elements in engagement with the well bore bottom, the areas of the cutting elements and the bottom available for impingement and cleaning by the stream is reduced and the flow of drilling fluid with entrained cuttings away from the well bore bottom is restricted.

In the manufacture of the first embodiment of the drill bit, the bit body 3 is formed from three so-called "lugs". Each lug is of one-piece forged construction, having an integrally formed bearing journal, leg 7, and elongate nozzle 15. The lugs are secured together in side-by-side relation as by welding along weld seams 27 to form a complete bit body.

Figure 4:
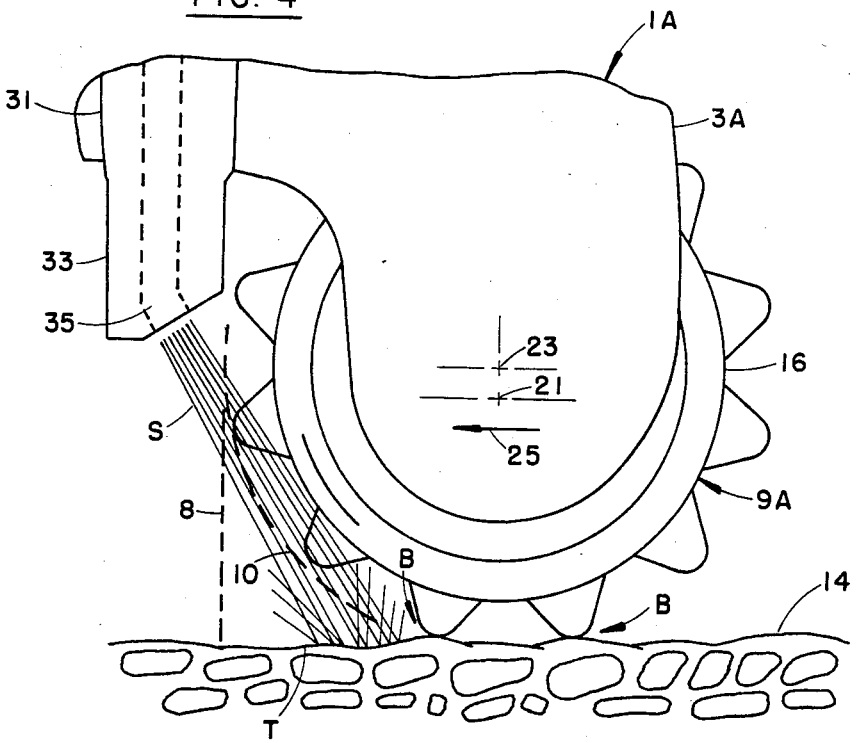
FIG. 4 is a view similar to FIG. 3 of a second embodiment of a drill bit of this invention.

FIG. 4 illustrates a second embodiment of the drill bit of this invention generally indicated at 1A which is similar to the first embodiment 1 except that the bit body 3A is formed of conventional lugs having relatively short vertically extending, integrally formed nozzles 31. A tubular member 33 having passaging 35 therein, which at one end thereof is in alignment with that in the nozzle 31 and which at the other end thereof directs the fluid to flow generally tangent to an adjacent roller cutter 9A, is welded to the underside of the bit body 3A at each nozzle 31.

Figure 7:
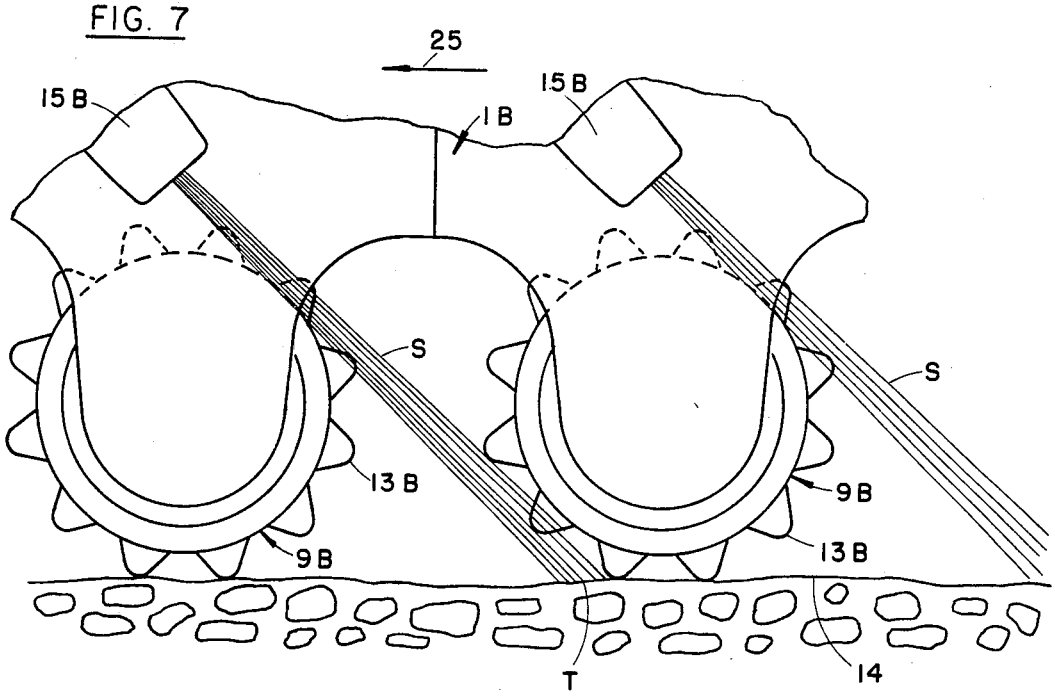
FIG. 7 is a developed side elevation of a third embodiment of the drill bit of this invention showing a nozzle directing a stream of drilling fluid toward the cutting elements of one roller cutter and toward the target portion of the well bore bottom associated with another roller cutter.

Referring to FIG. 7, there is illustrated at 1B a portion of a third embodiment of the drill bit of this invention which is similar to the above-described bits of the first and second embodiment 1, 1A except that its nozzle members 15B are positioned above the adjacent roller cutter 9B at the back or trailing side thereof. Each nozzle directs a stream of high velocity drilling fluid so as to flow generally toward and tangent to the upper portion of the cutter body 11B of the adjacent roller cutter 9B, to impinge cutting elements 13B on the roller cutter for cleaning them, and thereafter to impinge the target portion T of the well bore bottom forward of the following or trailing roller cutter 9B. Each roller cutter of the bit thus has its cutting elements 13B cleaned by the stream S of drilling fluid from the nozzle associated with that roller cutter, and the target portion T of the well bore bottom forward thereof cleaned by the stream of drilling fluid from the nozzle 15B associated with the preceding or leading roller cutter. Accordingly, cutting elements 13B on each of the roller cutters 9B and the target portion T of the well bore bottom 14 forward of each of the roller cutters are subject to separate, sequential cleaning actions for presenting clean engagement surfaces to enhance the drill bit cutting action. As with the first and second embodiments of the bit 1, 1A, the target portion T of the well bore bottom associated with the bit 1B of the third embodiment is cleaned immediately prior to its engagement by the cutting elements for presenting a clean engagement surface. In contrast to the bits 1, 1A of the first and second embodiments, the cutting elements of this bit 1B are impinged at a relatively large angular displacement from the bit bottom. Nonetheless, this impingement is separate from, and sequential to the impingement of the target portion and this cleaning action thus represents a significant improvement over the prior art drill bits in which there is no impingement of the cutting elements or only simultaneous impingement of the cutting elements and the well bore bottom.

Figure 8:
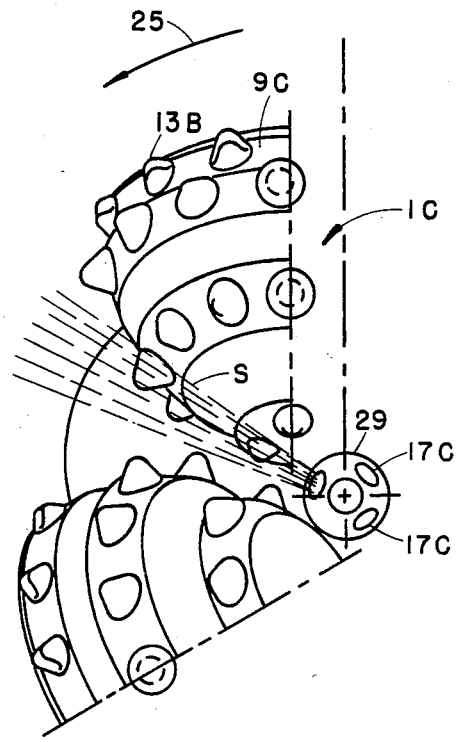
FIG. 8 is a partial bottom plan of a fourth embodiment of the drill bit of this invention showing a so-called "center jet" nozzle.
Figure 9:
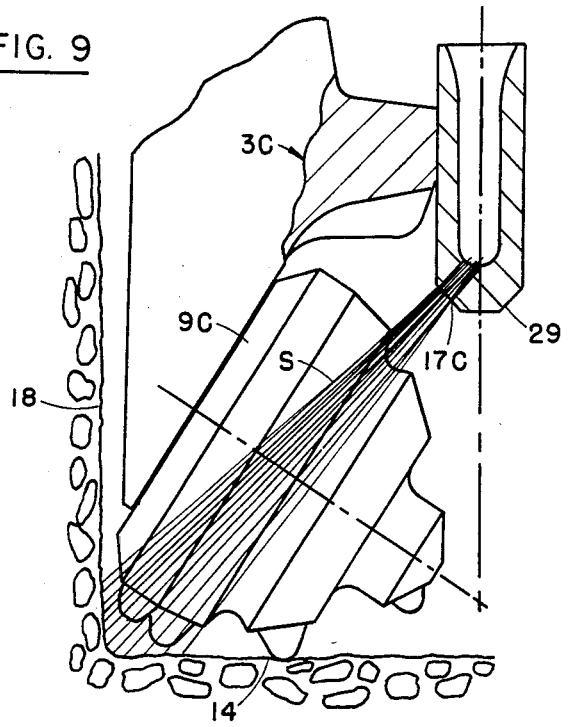
FIG. 9 is a partial vertical section of the drill bit of FIG. 8 showing the center jet nozzle and one roller cutter.

Referring to FIGS. 8 and 9, there is generally indicated at 1C a fourth embodiment of the drill bit of this invention similar to the first and second embodiments 1, 1A except that the nozzle means comprises a so-called "center-jet" nozzle 29 projecting down beneath the underside of the bit body at a central portion thereof. The nozzle has a plurality of nozzle orifices 17C (i.e., three such nozzle orifices 17C as illustrated). Each nozzle orifice directs a stream S of high velocity drilling fluid downwardly, rearwardly, and radially outwardly toward an adjacent roller cutter 9C. The stream of drilling fluid impinges cutting elements 13C on the roller cutter and thereafter at least some part or portion of the stream of drilling fluid impinges the target portion T of the well bore bottom 14 associated with the roller cutter. As with the first and second embodiments of the bit 1, 1A the cutting elements and the target portion of the well bore bottom of the bit 1C of the fourth embodiment are subject to separate, sequential cleaning actions just prior to their engagement for enhanced drill bit cutting action. As illustrated in FIG. 8, it is contemplated that the stream of drilling fluid may also impinge the side 18 of the well bore, as well as, the target portion T of the well bore bottom 14.

It is also contemplated that the bit 1C may correspond to the bit of the third embodiment 1B by positioning the nozzle member 29 so as to direct streams of drilling fluid toward the rear or trailing side of the adjacent roller cutter 9C, with the stream impinging cutting elements on the adjacent roller cutter and thereafter impinging the target portion T of the well bore bottom associated with the following or trailing roller cutter. Moreover, it is contemplated that the nozzle means may comprise a plurality of nozzle members each having a nozzle orifice spaced radially outwardly from the vertical centerline of the bit body, but radially inwardly from the periphery of the bit body (e.g., midway between the centerline and the periphery of the bit body).

While the roller cutters have been shown in the drawings and described above as comprising a roller cutter body and separate cutting elements mounted thereon, it is contemplated that the roller cutter could be of one-piece construction having integrally formed cutting elements, such as the roller cutter shown in U.S. Pat. No. 4,368,788.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A rotary drill bit for drilling a well bore, the bit comprising:

a bit body having a threaded pin at its upper end adapted to be detachably secured to a drill string for rotating the bit and delivering drilling fluid under pressure to the bit, a plurality of depending legs at its lower end, and nozzle means for exit of drilling fluid from the bit body; and a plurality of roller cutters, one for each leg, each roller cutter comprising a generally conical cutter body rotatably mounted on the respective leg and a plurality of cutting elements on the cutter body, each cutting element at least at a portion of its surface being formed of a material resistant to erosion by high velocity drilling fluid which may impinge it;

the nozzle means directing a plurality of streams of drilling fluid from the bit body, each stream being so directed as to flow generally toward the cutter body of a roller cutter, with the stream impinging at least one cutting element on the roller cutter, and thereafter impinging the well bore bottom at least in part at a generally triangular portion of the bottom which is within the vertical projection of the roller cutter on the well bore bottom and forward, with respect to the direction of rotation of the drill bit, of the points of engagement of the cutting elements of this latter roller cutter with the well bore bottom, whereby cutting elements on each roller cutter and portions of the well bore bottom beneath each roller cutter are subject to separate cleaning actions for enhanced drill bit cutting action.

2. A drill bit as set forth in claim 1 wherein said cutting elements are generally elongate members of tungsten carbide and are mounted on the roller cutter body with a portion thereof projecting outwardly beyond the generally conical surface of the roller cutter body.

3. A drill bit as set forth in claim 1 wherein the nozzle means comprises a plurality of nozzle members, each nozzle member having passaging and a nozzle orifice therein.

4. A drill bit as set forth in claim 1 wherein the nozzle means comprises a nozzle member on the underside of the bit body generally at the vertical centerline of the drill bit, the nozzle member having a plurality of nozzle orifices therein.

5. A drill bit as set forth in claim 1 wherein each stream of drilling fluid is so directed that the roller cutter having its cutting elements impinged by said stream and the roller cutter having a portion of the well bore bottom beneath it impinged by said stream are the same roller cutter.

6. A drill bit as set forth in claim 1 wherein each stream of drilling fluid is so directed that the roller cutter having its cutting elements impinged by the stream and the roller cutter having a portion of the well bore bottom beneath it impinged by the same stream are different roller cutters.

7. A drill bit as set forth in claim 1 wherein the cutting elements of each roller cutter are arranged in annular rows around the cutter body, each stream of drilling fluid impinging cutting elements of at least one of the outer rows of cutting elements of the respective roller cutter.

8. A rotary drill bit for drilling a well bore, the bit comprising:

a bit body having a threaded pin at its upper end adapted to be detachably secured to a drill string for rotating the bit and delivering drilling fluid under pressure to the bit, a plurality of depending legs at its lower end, and nozzle means for exit of drilling fluid from the bit body; and a plurality of roller cutters, one for each leg, each roller cutter comprising a generally conical cutter body rotatably mounted on the respective leg and a plurality of cutting elements on the cutter body, each cutting element at least at a portion of its surface being formed of a material resistant to erosion by high velocity drilling fluid which may impinge it;

the nozzle means directing a plurality of streams of drilling fluid from the bit body, each stream being so angled and positioned relative to the roller cutters that as a roller cutter rotates, cutting elements thereon enter a stream for being cleaned thereby with each of the cutting elements exiting the stream prior to engaging the formation at the well bore bottom, and with the stream after flowing past the cutting elements impinging the well bore bottom at least in part at a generally triangular portion of the bottom within a vertical projection of the roller cutter on the well bore bottom and forward, with respect to the directon of rotation of the drill bit, of the points of engagement of the cutting elements of this latter roller cutter with the well bore bottom, whereby cutting elements on each roller cutter and portions of the well bore bottom beneath each roller cutter are subject to separate cleaning actions for enhanced drill bit cutting action.

9. A drill bit as set forth in claim 8 wherein the nozzle means comprises a plurality of nozzle members, each nozzle member having passaging and a nozzle orifice therein.

10. A drill bit as set forth in claim 8 wherein the nozzle means comprises a nozzle member on the underside of the bit body generally at the vertical centerline of the drill bit, the nozzle member having a plurality of nozzle orifices therein.

11. A drill bit as set forth in claim 8 wherein each stream of drilling fluid is so directed that the roller cutter having its cutting elements impinged by said stream and the roller cutter having a portion of the well bore bottom beneath it impinged by said stream are the same roller cutter.

12. A drill bit as set forth in claim 8 wherein each stream of drilling fluid is so directed that the roller cutter having its cutting elements impinged by said stream and the roller cutter having a portion of the well bore bottom beneath it impinged by said stream are different roller cutters.

* * * * *